US005564613A

United States Patent [19]

Baldyga

[11] Patent Number: 5,564,613

[45] Date of Patent: Oct. 15, 1996

[54] RESILIENTLY URGED TERMINAL STRIP GUIDE

[75] Inventor: Joseph Baldyga, Naples, Fla.

[73] Assignee: Diamond Die & Mold Company, Mt. Clemens, Mich.

[21] Appl. No.: 245,578

[22] Filed: May 18, 1994

[51] Int. Cl.[6] ..... B65H 23/28; H01R 43/04

[52] U.S. Cl. ..... 226/198; 29/566.2

[58] Field of Search ..... 226/196, 198; 72/338, 361, 428; 29/566.2, 753, 759

[56] References Cited

U.S. PATENT DOCUMENTS

| | | | |
|---|---|---|---|
| 3,456,480 | 7/1969 | Baldyga | 72/362 |
| 3,553,814 | 1/1971 | Rider | 29/203 |
| 3,578,230 | 5/1971 | Baldyga | 226/162 |
| 3,636,636 | 1/1972 | Baldyga | 33/185 |
| 3,791,191 | 2/1974 | Baldyga | 72/431 |
| 3,795,962 | 3/1974 | Baldyga | 29/203 D |
| 3,896,983 | 7/1975 | Weinguni | 226/198 |
| 3,911,721 | 10/1975 | Baldyga | 72/441 |
| 3,976,235 | 8/1976 | Baldyga et al. | 226/11 |
| 3,977,587 | 8/1976 | Baldyga et al. | 226/74 |
| 4,019,362 | 4/1977 | McKeever | 226/167 X |
| 4,114,253 | 9/1978 | Loomis et al. | 29/566.2 |
| 4,134,201 | 1/1979 | McDonough et al. | 29/566.2 |
| 4,272,879 | 6/1981 | Wigby | 29/566.2 |
| 4,335,497 | 6/1982 | Casey | 29/566.2 |
| 4,598,570 | 7/1986 | Baldyga | 72/338 |
| 4,654,952 | 4/1987 | Baldyga | 29/566.2 |
| 4,654,962 | 4/1987 | Baldyga | 29/566.2 |
| 4,707,913 | 11/1987 | Moline | 29/753 |
| 4,718,160 | 1/1988 | Bulanda et al. | 226/198 X |
| 4,741,102 | 5/1988 | Baldyga | 29/861 |
| 4,938,407 | 7/1990 | St. Hilaire | 226/196 |
| 5,033,187 | 7/1991 | Gloe et al. | 29/753 |
| 5,109,602 | 5/1992 | Fukuda | 29/845 |
| 5,127,255 | 7/1992 | Skotek | 72/428 X |
| 5,170,921 | 12/1992 | Baldyga | 226/52 |
| 5,176,228 | 1/1993 | Baldyga | 188/67 |

*Primary Examiner*—Daniel P. Stodola
*Attorney, Agent, or Firm*—Young & Basile, P.C.

[57] ABSTRACT

A terminal guide rail assembly attached along a worktable to position a terminal strip in alignment as it moves along the worktable and is received at the crimping and cutting machine. The terminal guide rail assembly has a lower guide rail mounted to the worktable and upper guide rail movable relative to the lower guide rail which is biased by compression springs to align a projecting ridge on the upper guide rail between generally U-shaped terminal portions. The terminal edges are biased against an inner portion of the lower guide rail.

6 Claims, 2 Drawing Sheets

RESILIENTLY URGED TERMINAL STRIP GUIDE

FIELD OF THE INVENTION

The present invention relates to an apparatus and method of guiding terminals into a wire crimp station.

BACKGROUND OF THE INVENTION

Today's high quality production requirements have created a need for an improved means of guiding terminals spaced along a terminal strip into a wire crimp station. The wire crimp station includes a die and an anvil reciprocal with respect to one another for crimping a bare wire end of a conductor onto the barrel end of a terminal and severing the terminal from the strip.

Various types of terminal guides are currently in use in the industry today, and typically require a minimum of 0.015 total clearance between the guide and the terminal, which throws the critical crimp area out of tolerance. In addition, a cut-off tail is often left attached to a terminal after it is severed from the strip. The present invention provides a terminal guide which keeps the terminal locked against three separate faces by three guide contact points. This permits the terminal to be fed into the wire crimp station in proper position at all times to provide accurate crimping and a complete severance of the terminal from the strip.

SUMMARY OF THE INVENTION

The terminal guide of the present invention is specifically designed for use in conjunction with a feeding mechanism employed to feed a continuous strip having electrical terminals uniformly spaced along the strip in step by step movement on a feed table to a die and punch mechanism where the terminals are severed from the strip and crimped on the end of an electrical conductor.

The terminal guide is a rail guide assembly including a lower guide rail and an upper guide rail. The lower guide rail is in a fixed relationship along the side of the feed table extending parallel to the path of movement of the terminal carrier strip; and extending partially across the top surface of the feed table. A clearance is provided between the top of the feed table and a bottom face of the lower guide rail for receiving the terminal carrier strip. The lower guide rail has two open ended pockets spaced from each other and open to a vertical face of the lower guide rail. Disposed within the pockets are compression springs. A second vertical face of the lower guide rail provides a guide for the terminal ends when passing through the lower and upper rails. An upper face of the lower guide rail has a pair of threaded apertures for receiving screws extending from the upper guide rail for securing the lower guide rail thereto.

The upper guide rail is designed to rest parallel to the path of movement of the carrier strip along the length of the feed table above the lower guide rail. Along one lateral side of the upper guide rail is a projecting ridge extending downwardly toward the feed table that aligns with a portion of the terminals as the terminals pass under the guide rail. The projecting ridge extends the length of the upper guide rail. Along the other lateral side of the upper guide rail is a vertical ledge that abuts against the compression springs. The vertical ledge of upper guide rail is biased by the compression springs away from the vertical face of the lower guide rail so that the projecting ridge biases the terminals carried on the elongated terminal strip to align the ends of the terminals along the second vertical face of the lower guide rail as the terminals approach the wire crimp station. Therefore, the terminal strip is kept in alignment as it approaches the wire crimp station at three contact points; 1) the feed table provides a horizontal contact, 2) the vertical face of the lower guide rail contacts ends of the terminals, and 3) the projecting ridge biased by the compression springs contacts a portion of the terminal.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
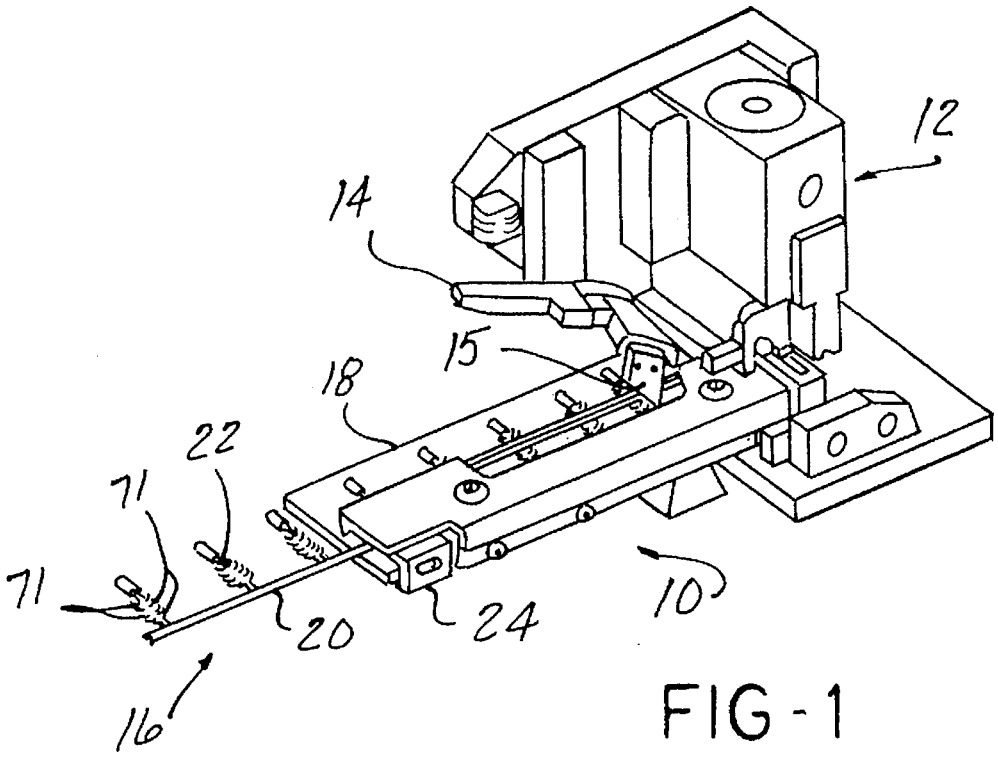
FIG. 1 is a perspective view of a crimping die and feed mechanism employing the present invention.
Figure 3:
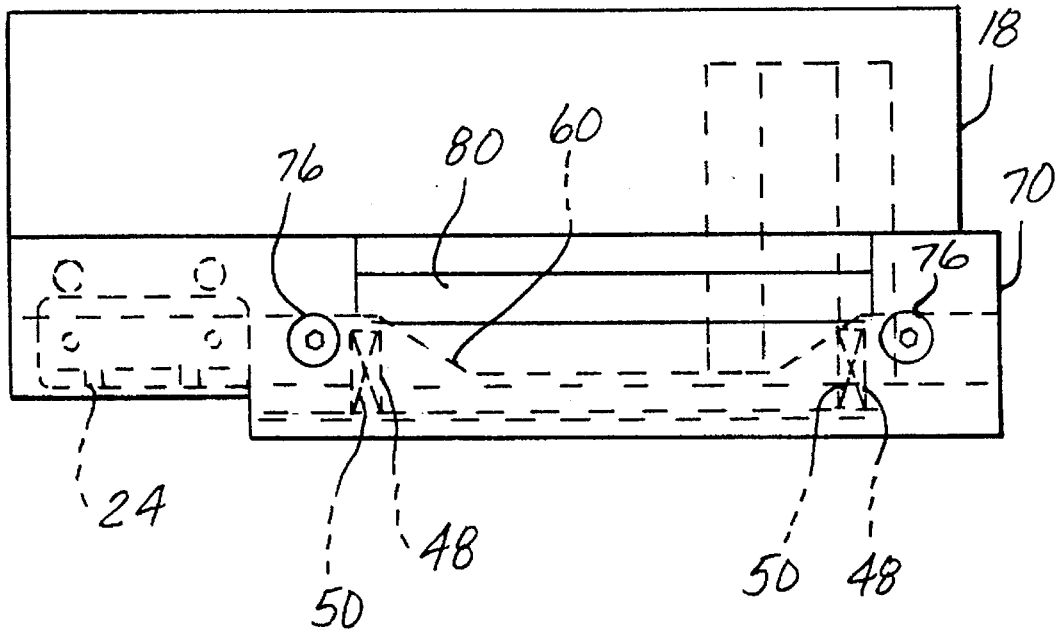
FIG. 3 is a top view of the guide rail assembly of the present invention, with certain portions of the feed table on which the assembly is mounted and an electric terminal strip shown in broken lines.

Referring first to FIG. 1, a guide rail assembly embodying the present invention, designated generally 10 is shown installed on a typical electrical terminal crimping machine which includes a crimping die designated generally 12 and a terminal strip feed mechanism designated 14 for feeding an electric terminal strip designated generally 16 to the crimping die 12. Crimping die 12 and feed mechanism 14 for purposes of the present invention may be assumed to be of known construction, die 12 may, for example, take the form that is shown in U.S. Pat. No. 4,598,570. Feed mechanism 14 may include a stationary feed table or worktable 18 for supporting the strip 16 and a finger feed 15 movable toward die 12. Terminal strip 16 takes the form of continuous elongate carrier strip 20 having individual electrical terminals 22 integrally formed on strip 20 at uniformly spaced intervals. A self contained brake assembly 24 mounted on the strip feeding device 14 and adapted to apply adjustable frictional braking force to the strip 20 as disclosed in U.S. Pat. No. 5,176,228 may also be included.

Figure 2:
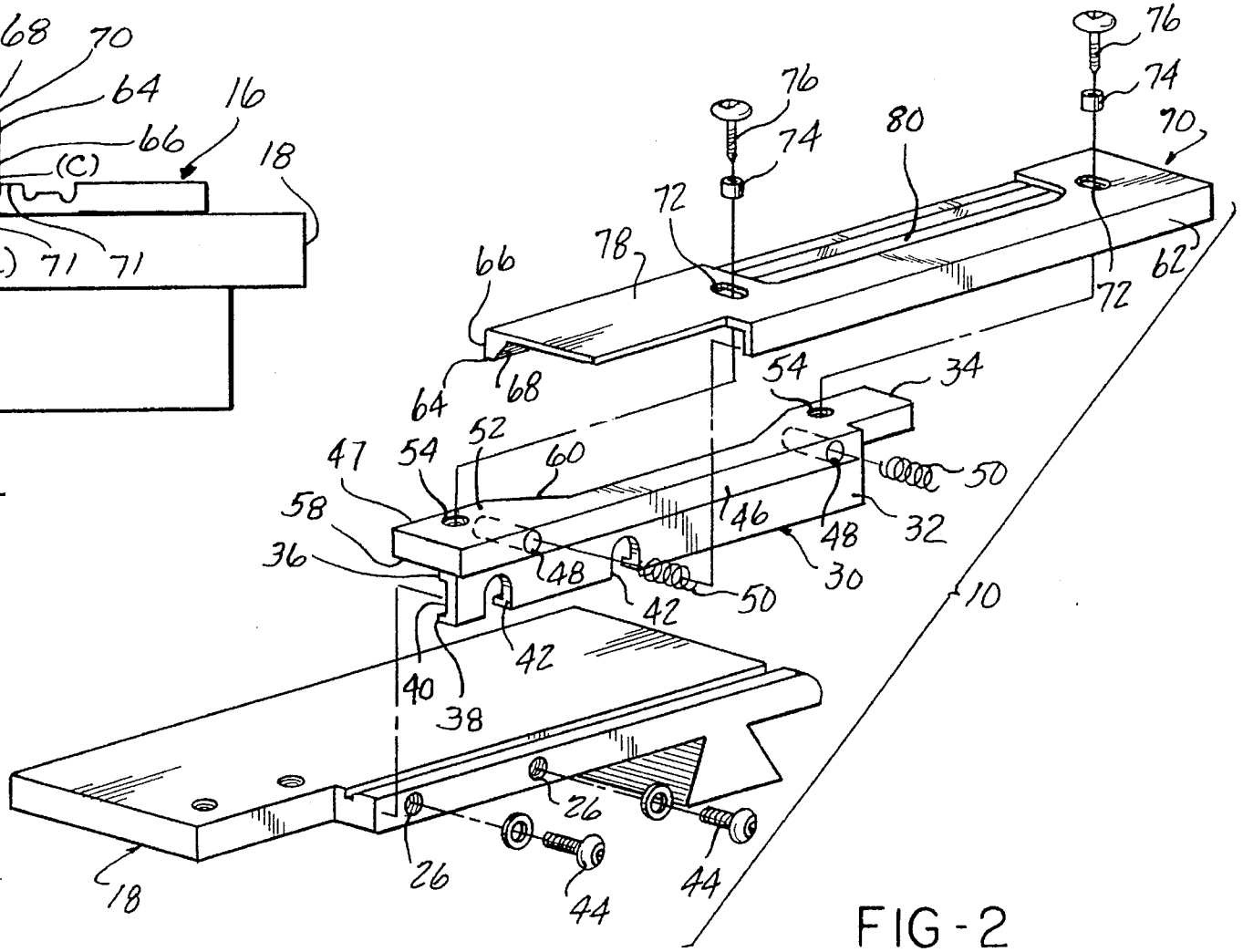
FIG. 2 is an exploded perspective view showing the individual parts of the guide rail assembly of the present invention and a feed table portion of the assembly illustrated in FIG. 1.

In FIG. 2, the individual parts of the terminal guide rail 10 are shown in an exploded view together with worktable 18 of the feed mechanism of FIG. 1. The worktable 18 is slightly modified from a conventional form to accommodate the guide rail on one edge of the table with a pair of tapped bores 26.

In accordance with the present invention, the terminal guide assembly 10 includes a lower guide rail 30 having a vertical mounting flange 32 integrally joined to a horizontal plate 34. The vertical mounting flange 32 has a pair of spaced lips 36, 38 integrally joined to and extending from an inner side 40 of the vertical mounting flange 32. The vertical mounting flange 32 also has a pair of through apertures 42 corresponding to the pair of tapped bores on the worktable 18. The through apertures 42 of the vertical mounting flange 32 enable the lower guide rail to be fixedly mounted on the worktable 18 by mounting screws 44 which pass through apertures 42 and are threaded into bores 26 in the table 18. As the lower guide rail 30 is secured to worktable 18, the upper and lower lips 36, 38 grip an upper and lower surface of the worktable 18 so that the inner side 40 of the vertical mounting flange 32 is flush against a vertical edge of the worktable 18.

The horizontal plate 34 of the lower guide rail 30 has a first vertical face 46, a second vertical face 47, an upper horizontal face 52 and a lower horizontal face 58. The first vertical face 46 has a pair of pockets or recesses 48 defining spring seats that each house a helical compression spring 50. The upper horizontal face 52 has a pair of tapped bores 54 for mounting the upper guide rail 70. In the preferred embodiment, the horizontal plate 34 also includes a clearance recess 60 along one edge of plate 34 parallel to the movement of the carrier strip 20 to accommodate the finger feed 15 as shown in FIG. 1. When the lower guide rail 30 is mounted to the worktable 18, a clearance 56 for the terminal carrier strip 20 is provided between the lower horizontal face 58 and the worktable 18, as best seen in FIG. 4.

The upper guide rail 70 extends over the horizontal plate 34 of the lower guide rail 30. The upper guide rail 70 has horizontally spaced vertical extensions extending therefrom. The first vertical extension 62 abuts against the compression springs 50 and adjacent to the first vertical face 46 of the horizontal plate 34. The second vertical extension 64 has an outer vertical edge 66 and an angular inner edge 68 along the length to form a projecting ridge 64 for purposes to be explained below. The horizontal surface 78 of the upper guide plate 70 has a pair of elongated slots 72 which correspond to tapped bores 54 on the horizontal plate 34 of the lower guide rail 30. The elongated slots 72 receive bushings 74 and screws 76 to mount to the lower guide rail 30. The shape of the elongated slot 72 allows the upper guide rail 70 to move a limited distance perpendicular to the movement of the carrier strip 20 and relative to the lower guide rail 30. In the preferred embodiment, the horizontal surface 78 of the upper guide rail 70 also includes an elongated aperture 80 parallel to the movement of the terminal carrier strip 20 and corresponding to the recess area 60 in the lower guide rail 30 to provide a through access for the finger feed 15 to the terminal strips 16.

When assembled to the worktable 18, the lower guide rail 30 is positioned against the worktable 18 so that the vertical mounting flange 32 abuts the vertical end of the worktable in position so that the pair of through apertures 42 correspond to the pair of tapped bores 26 in the worktable. A helical compression spring 50 is inserted into each pocket 48 of the horizontal plate 34. The upper guide rail 70 is then aligned over the lower guide rail 30 so that the elongated slots 72 align with the tapped bores 54 of the horizontal plate 34. In addition, the first vertical extension 62 of the upper guide rail 70 abuts against the compression springs 50, adjacent to the vertical face 46 of the lower guide rail 30. The compression springs 50 bias the first vertical extension 62 away from vertical face 46 so that the projecting ridge extension 64 moves the terminal in the direction toward the second vertical face 47 of the lower guide rail and the end of the terminal 22 abuts the second vertical face 47. The elongated slots 72 of the upper guide rail 70 limits the movement of the upper guide rail 70 in the direction perpendicular to the movement of the carrier strip, and thereby limits the movement of the projecting ridge 64 against the terminals.

Figure 4:
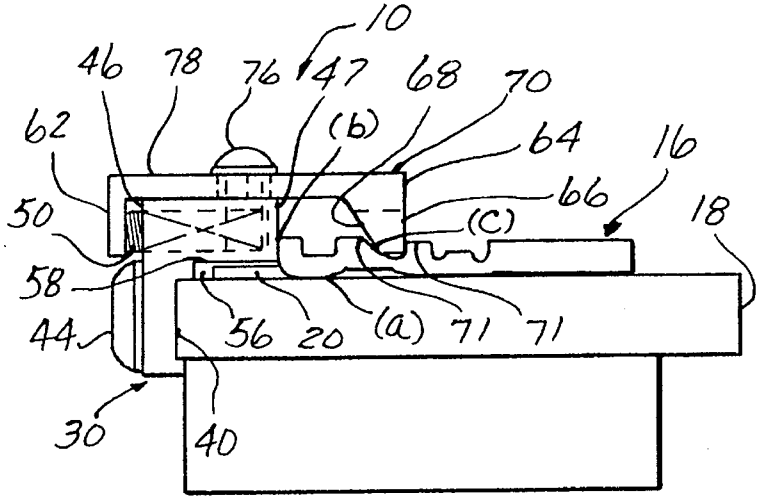
FIG. 4 is an end view of FIG. 3 with portions of the work table and a terminal strip indicated.

As best seen in FIG. 4, the terminal strip 16 is aligned at three contact points as it travels through and past the terminal guide rails 10. The worktable 18 provides one contact edge (a) along the horizontal surface. The second vertical face 47 of the lower guide rail 30 provides a second contact edge (b) which can be adjusted to abut the end of the terminal. The projecting ridge 64 of the upper guide rail 70 provides a third contact (c). The upper guide rail 70 can be adjusted within the confines of the elongated slot 72 to position the projecting ridge 64 between two generally parallel U-shaped portions 71 of the terminal 22. In this manner, as seen in FIG. 4, the terminal strip is held in position up to the anvil and crimping machine. This assembly provides a more accurate crimping and cutting operation that eliminates cut-off tails from the terminal strips normally left on the terminals in the cutting operation.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A terminal guide apparatus for aligning a terminal connected to at least one carrier strip moveable longitudinally along a fixed path on a worktable, said carrier strip having a plurality of individual electrical terminals connected thereto, wherein each electrical terminal has upwardly extending portions, the terminal guide apparatus comprising:

a lower guide rail mounted on said fixed path, said lower guide rail having a generally L-shaped cross section with a first vertical face, a second vertical face, an upper horizontal face connecting said first and second vertical faces and a lower horizontal face extending inwardly with respect to said second vertical face, said first vertical face having a pocket defining a spring seat;

an upper guide rail mounted on the upper horizontal face of the lower guide rail for movement relative to the lower guide rail, said upper guide rail having a generally inverted, U-shaped cross section with a first horizontal surface, a first vertical extension and a second vertical extension horizontally spaced from one another and extending downwardly from said first horizontal surface such that the first vertical extension opposingly faces said first vertical face of said lower rail and the second vertical extension opposingly faces said second vertical face of said lower rail and is positionable between the upwardly extending portions of said terminals; and compression spring means for biasing the first vertical extension to move the terminals toward the second vertical face of the lower guide rail, one end of the compression spring means engaging the spring seat of the lower rail and the opposite end of the compression spring means engaging the first vertical extension of the upper rail.

2. The terminal guide apparatus of claim 1 further comprising connecting means for mounting said upper guide rail to said lower guide rail, wherein the upper guide rail includes elongated slots through the first horizontal surface, and the lower guide rail includes apertures for receiving said connecting means, wherein said elongated slots allow limited movement of the upper guide rail relative to the lower guide rail.

3. The terminal guide apparatus of claim 1 wherein the second vertical extension has a first surface angled with respect to a vertical surface to form a projecting ridge positionable between two upwardly extending portions of the terminal transversely spaced from one another with respect to said fixed path wherein the first angled surface opposes both the worktable and said second vertical face of said lower rail.

4. The terminal guide apparatus of claim 3 wherein the lower horizontal face of the lower guide rail is spaced vertically from the fixed path on the worktable to define a longitudinally extending slot along the fixed path, said slot having sufficient clearance to allow for movement of the carrier strip along the fixed path within said slot.

5. A terminal guide apparatus for aligning a terminal connected to at least one carrier strip moveable longitudinally along a fixed path, feed means for moving said terminal having a feed finger engageable with said carrier strip, said carrier strip having a plurality of individual electrical terminals connected thereto wherein each electrical terminal has upwardly extending portions, the terminal guide apparatus comprising:

a lower guide rail mounted on said fixed path, said lower guide rail having a generally L-shaped cross section with a first vertical face, a second vertical face, an upper horizontal face connecting the first and second vertical faces, and lower horizontal face extending inwardly with respect to the second vertical face, said first vertical face having a pair of pockets and said second vertical face having a longitudinally extending recessed portion;

an upper guide rail mounted on the upper horizontal face of the lower rail for movement relative to the lower guide rail, said upper guide rail having a generally inverted U-shaped cross section with a first horizontal surface and a first vertical extension and a second vertical extension horizontally spaced from one another and extending downwardly from said first horizontal surface such that the first vertical extension opposingly faces said first vertical face of said lower rail and the second vertical extension opposingly faces said second vertical face of said lower rail and is positionable between the upwardly extending portions of said terminals; and spring means for biasing the upper guide rail to move the terminal toward the second vertical face of the lower guide rail, wherein said spring means has one end engageable with said pockets of said lower guide rail and an opposite end of the spring means engageable with said first vertical extension of said upper guide rail.

6. A terminal guide apparatus for aligning a terminal connected to at least one carrier strip movable longitudinally along a fixed path, feed means for moving said terminal along said fixed path and having a feed finger engageable with said carrier strip, said carrier strip having a plurality of individual electrical terminals connected thereto, the terminal guide apparatus comprising:

a lower guide rail mounted along a portion of said fixed path, said lower guide rail having a first vertical face, a second vertical face, an upper horizontal face and a lower horizontal face, said first vertical face having a pair of pockets, and a recessed portion formed longitudinally along said second vertical face;

an upper guide rail mounted on the upper horizontal face of the lower guide rail for movement relative to the lower guide rail, said upper guide rail having a horizontal surface, a first vertical extension and a second vertical extension horizontally spaced from one another and extending from said horizontal surface, wherein said first vertical extension is disposed adjacent to said first vertical face of the lower guide rail, and said second vertical extension is positionable between a portion of said terminals; and spring means engaged between said pockets in said first vertical face of said lower guide rail and said first extension of said upper guide rail for biasing the first and second vertical extensions to move the terminal toward the second vertical face of the lower guide rail, wherein the upper guide rail has an elongated aperture corresponding to the recessed portion of the lower guide rail to provide access for the feed finger to the carrier strip of the terminals.

* * * * *